US006663367B2

(12) United States Patent
Yamamoto et al.

(10) Patent No.: US 6,663,367 B2
(45) Date of Patent: Dec. 16, 2003

(54) SHAFT SEAL STRUCTURE OF VACUUM PUMPS

(75) Inventors: Shinya Yamamoto, Kariya (JP); Masahiro Kawaguchi, Kariya (JP); Ryosuke Koshizaka, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/086,119

(22) Filed: Feb. 26, 2002

(65) Prior Publication Data

US 2002/0168279 A1 Nov. 14, 2002

(30) Foreign Application Priority Data

Feb. 28, 2001 (JP) ..... 2001-054450

(51) Int. Cl.[7] ..... F04C 18/18; F04C 27/00; F16J 15/16

(52) U.S. Cl. ..... 418/104; 418/88; 418/206.6; 277/400; 277/430

(58) Field of Search ..... 418/88, 104, 206.6, 418/206.8; 277/399, 400, 423, 430

(56) References Cited

U.S. PATENT DOCUMENTS 1,539,941 A * 6/1925 Gentry ..... 277/430
4,545,588 A * 10/1985 Nagai et al. ..... 277/430
4,632,650 A 12/1986 Frieden et al. ..... 418/95
4,990,069 A * 2/1991 Guittet et al. ..... 418/104
5,009,583 A * 4/1991 Carlsson et al. ..... 418/104
5,069,278 A * 12/1991 Blair ..... 277/430
6,095,780 A * 8/2000 Ernens ..... 418/104

FOREIGN PATENT DOCUMENTS

| | | | |
|---|---|---|---|
| JP | 60-145475 | 7/1985 | |
| JP | 02-157490 | 6/1990 | |
| JP | 03-089080 | 4/1991 | |
| JP | 3-242489 | * 10/1991 | ..... 418/88 |
| JP | 06-081788 | 3/1994 | |
| JP | 06-101674 | 4/1994 | |
| JP | 09-196186 | 7/1997 | |

* cited by examiner

*Primary Examiner*—John J. Vrablik
(74) *Attorney, Agent, or Firm*—Morgan & Finnegan, LLP

(57) ABSTRACT

A Roots pump rotates a plurality of rotors by a pair of rotary shafts to draw gas. Each rotary shaft extends through a rear housing member of the Roots pump. An annular shaft seal is fitted around each rotary shaft and is received in a recess formed in the rear housing member. A helical groove is formed in a circumferential side of each rotary shaft. Each helical groove urges oil between the circumferential side of the associated shaft seal and the circumferential wall of the recess to move from a side corresponding to pump chambers toward a gear accommodating chamber when the associated rotary shaft rotates. This preferably prevents oil from leaking to the pump chambers.

17 Claims, 10 Drawing Sheets

M
11
12
13
14
15
17
19
20
21
22
23
24
25
26
27
28
29
30
31
32
33
34
35
36
37
38
39
40
41
42
43
44
45
46
47
48
49
50
51
52
53
54
55
56
163
16
191
192
193
201
202
203
331
371
381
471
481
531
541
2a
2b
2c

SHAFT SEAL STRUCTURE OF VACUUM PUMPS

BACKGROUND OF THE INVENTION

The present invention relates to shaft seal structures of vacuum pumps that draw gas by operating a gas conveying body in a pump chamber through rotation of a rotary shaft.

Japanese Laid-open Patent Publication Nos. 60-145475, 2-157490, 3-89080, 6-101674 describe a vacuum pump that includes a plurality of rotors. Each rotor functions as a gas conveying body. Two rotors rotate as engaged with each other, thus conveying gas through a pump chamber. More specifically, one rotor is connected to a first rotary shaft and the other is connected to a second rotary shaft. A motor drives the first rotary shaft. A gear mechanism transmits the rotation of the first rotary shaft to the second rotary shaft.

The gear mechanism is located in an oil chamber that retains lubricant oil. The pump of Japanese Laid-open Patent Publication No. 60-145475 uses a labyrinth seal that seals the space between the oil chamber and the pump chamber to prevent the lubricant oil from leaking from the oil chamber to the pump chamber. More specifically, a partition separates the oil chamber from the pump chamber and has a through hole through which a rotary shaft extends. The labyrinth seal is fitted between the wall of the through hole and the corresponding portion of the rotary shaft. The pump of Japanese Laid-open Patent Publication No. 2-157490 employs a lip seal that seals the space between an oil chamber and a pump chamber. The pump of Japanese Laid-open Patent Publication No. 3-89080 includes a bearing chamber for accommodating a bearing that supports a rotary shaft. An intermediate chamber is formed between the bearing chamber and the pump chamber. A partition separates the bearing chamber from the intermediate chamber and has a through hole through which a rotary shaft extends. A labyrinth seal is fitted between the wall of the through hole and the rotary shaft. The pump of Japanese Laid-open Patent Publication No. 6-101674 includes a lip seal and a labyrinth seal. The seals are fitted between the wall of a through hole of a partition that separates the oil chamber from the pump chamber and a rotary shaft that extends through the through hole.

However, it is difficult to reliably stop an oil leak only with a lip seal or a labyrinth seal. For example, in the pump of Japanese Laid-open Publication No. 6-101674, which uses the lip seal and the labyrinth seal, if the life of the lip seal comes to an end, the oil leak must be stopped only by the labyrinth seal. The stopping of the oil leak thus becomes less reliable.

BRIEF SUMMARY OF THE INVENTION

Accordingly, it is an objective of the present invention to improve an effect of a vacuum pump of preventing oil from leaking to a pump chamber.

To achieve the foregoing and other objectives and in accordance with the purpose of the present invention, the present invention provides a vacuum pump that draws gas by operating a gas conveying body in a pump chamber through rotation of a rotary shaft. The vacuum pump includes an oil housing member, which forms an oil zone adjacent to the pump chamber. The rotary shaft has a projecting section that projects from the pump chamber to the oil zone through the oil housing member. An annular shaft seal is located around the projecting section to rotate integrally with the rotary shaft. The shaft seal has a first seal forming surface that opposes the oil housing member. A second seal forming surface is formed on the oil housing member. The second seal forming surface opposes the first seal forming surface. A pumping means is formed at the first seal forming surface. The pumping means urges oil between the first and second seal forming surfaces to move from a side corresponding to the pump chamber toward the oil zone when the rotary shaft rotates.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objectives and advantages thereof, may best be understood by reference to the following description of the presently preferred embodiments together with the accompanying drawings in which:

FIG. 1(*b*) is an enlarged cross-sectional view showing a seal structure around a first rotary shaft of the pump of FIG. 1(*a*);

FIG. 1(*c*) is an enlarged cross-sectional view showing a seal structure around a second rotary shaft of the pump of FIG. 1(*a*);

FIG. 2(*b*) is a cross-sectional view taken along line 2*b*—2*b* of FIG. 1(*a*);

FIG. 2(*c*) is a cross-sectional view taken along line 2*c*—2*c* of FIG. 1(*a*);

FIG. 4(*b*) is an enlarged plan view showing a main portion of a seal structure fitted around a second rotary shaft;

FIG. 9(*b*) is a cross-sectional view showing the Roots pump of the sixth embodiment, as taken along the boundary between a cylinder block and a rear housing member;

FIG. 10(*b*) is a cross-sectional view taken along line 10*b*—10*b* of FIG. 9(*b*).

DETAILED DESCRIPTION OF THE PREFERRED EMBODIMENTS

A first embodiment of a multiple-stage Roots pump 11 according to the present invention will now be described with reference to FIGS. 1 to 4(*b*).

Figure 1:
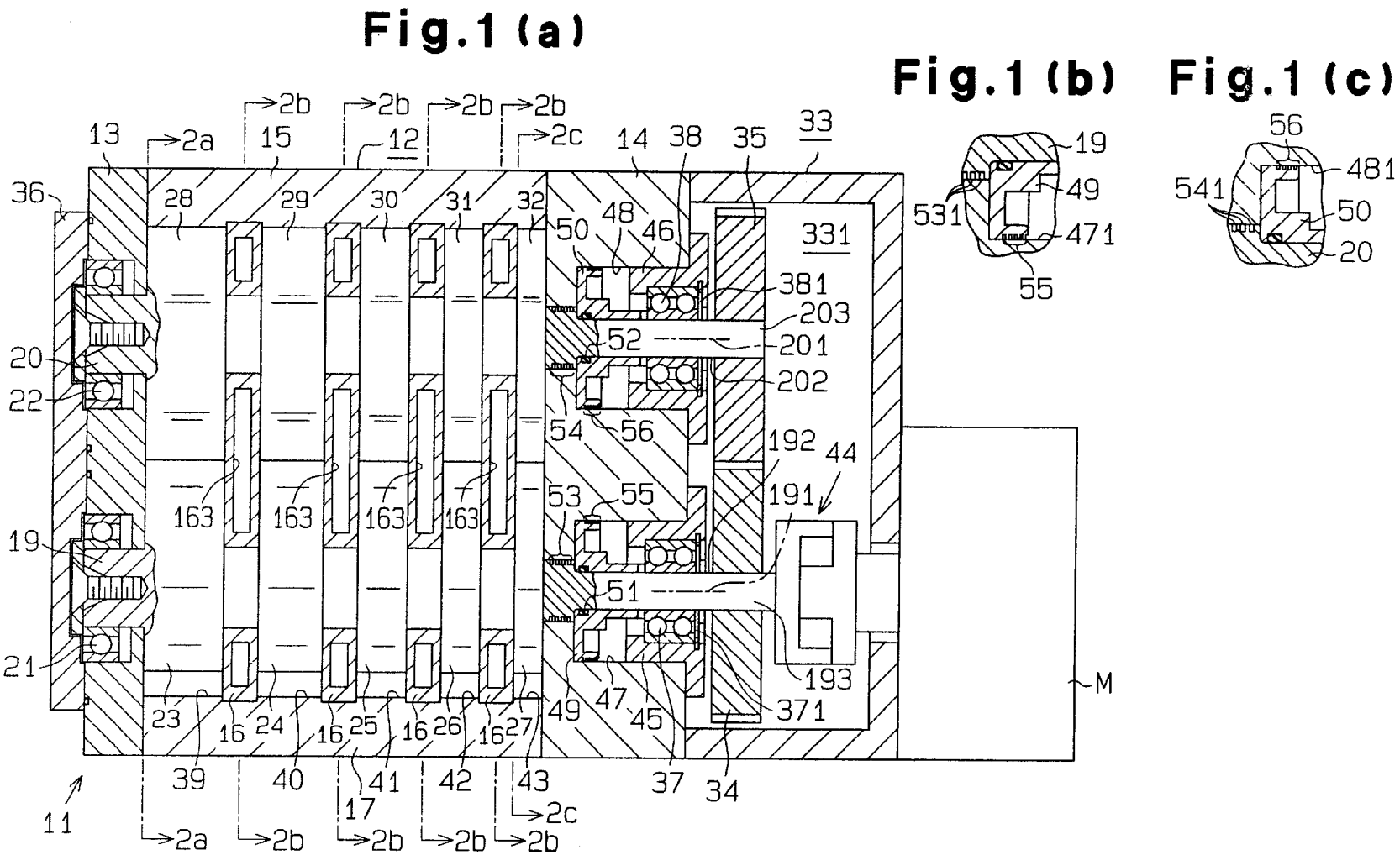
FIG. 1(*a*) is a cross-sectional plan view showing a multiple-stage Roots pump of a first embodiment according to the present invention.
Figure 2A:
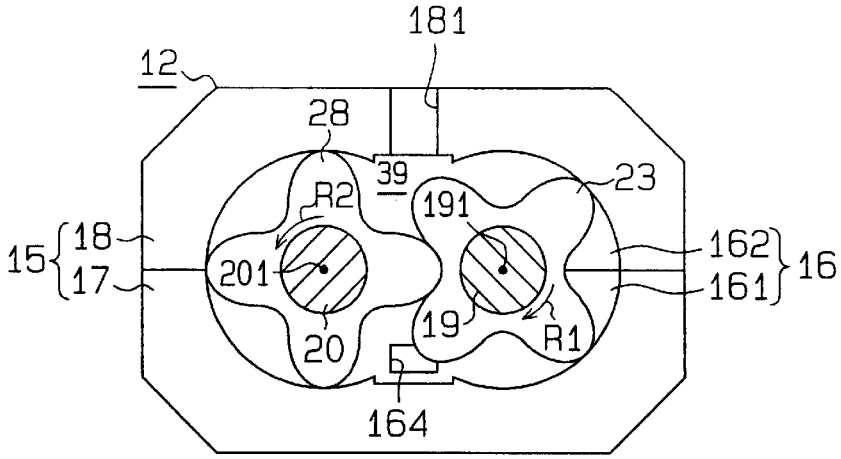
FIG. 2(*a*) is a cross-sectional view taken along line 2*a*—2*a* of FIG. 1(*a*)
Figure 2B:
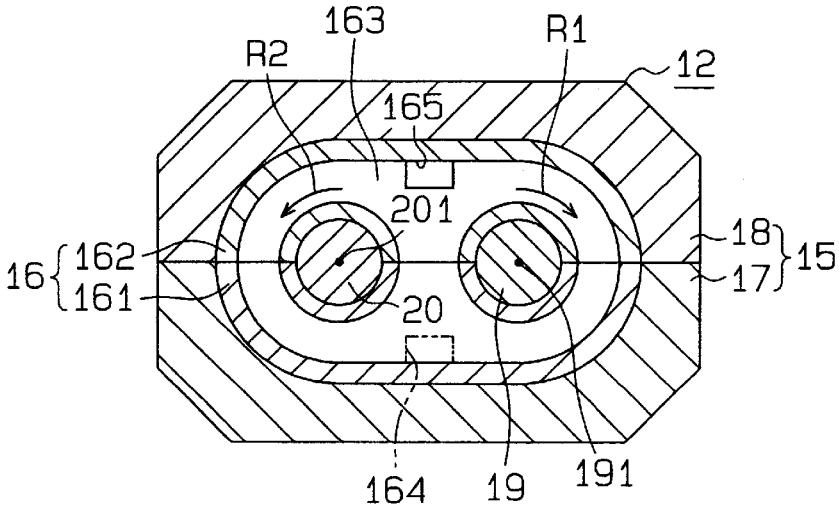
Figure 2C:
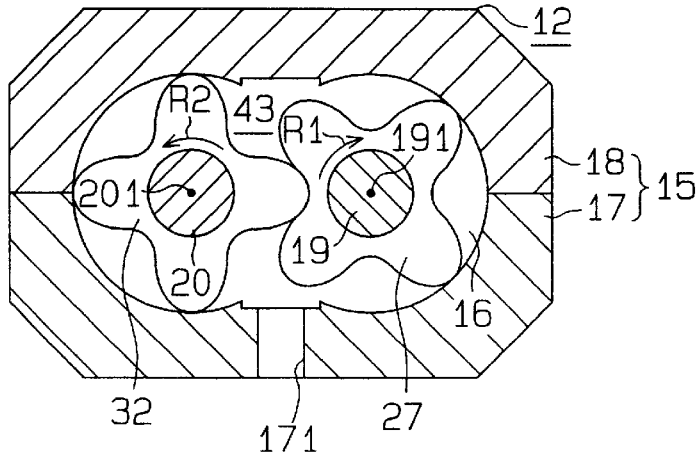

As shown in FIG. 1(*a*), the pump 11, or a vacuum pump, includes a rotor housing member 12 and a front housing member 13. The housing members 12, 13 are joined together. A lid 36 closes the front side of the front housing member 13. A rear housing member 14 is connected to the rear side of the rotor housing member 12. The rotor housing member 12 includes a cylinder block 15 and a plurality of (in this embodiment, four) chamber forming walls 16. As shown in FIG. 2(*b*), the cylinder block 15 includes a pair of block sections 17, 18, and each chamber forming wall 16 includes a pair of wall sections 161, 162. The chamber forming walls 16 are identical to one another.

As shown in FIG. 1(*a*), a first pump chamber 39 is formed between the front housing member 13 and the leftmost chamber forming wall 16, as viewed in the drawing. Second, third, and fourth pump chambers 40, 41, 42 are respectively formed between two adjacent chamber forming walls 16 in this order, as viewed from the left to the right in the drawing. A fifth pump chamber 43 is formed between the rear housing member 14 and the rightmost chamber forming wall 16.

A first rotary shaft 19 is rotationally supported by the front housing member 13 and the rear housing member 14 through a pair of radial bearings 21, 37. A second rotary shaft 20 is rotationally supported by the front housing member 13 and the rear housing member 14 through a pair of radial bearings 22, 38. The first and second rotary shafts 19, 20 are parallel with each other and extend through the chamber forming walls 16. The radial bearings 37, 38 are supported respectively by a pair of bearing holders 45, 46 that are installed in the rear housing member 14. The bearing holders 45, 46 are fitted respectively in a pair of recesses 47, 48 that are formed in the rear side of the rear housing member 14.

First, second, third, fourth, and fifth rotors 23, 24, 25, 26, 27 are formed integrally with the first rotary shaft 19. Likewise, first, second, third, fourth, and fifth rotors 28, 29, 30, 31, 32 are formed integrally with the second rotary shaft 20. As viewed in the directions of the axes 191, 201 of the rotary shafts 19, 20, the shapes and the sizes of the rotors 23–32 are identical. However, the axial dimensions of the first to fifth rotors 23–27 of the first rotary shaft 19 become gradually smaller in this order. Likewise, the axial dimensions of the first to fifth rotors 28–32 of the second rotary shaft 20 become gradually smaller in this order.

The first rotors 23, 28 are accommodated in the first pump chamber 39 as engaged with each other. The second rotors 24, 29 are accommodated in the second pump chamber 40 as engaged with each other. The third rotors 25, 30 are accommodated in the third pump chamber 41 as engaged with each other. The fourth rotors 26, 31 are accommodated in the fourth pump chamber 42 as engaged with each other. The fifth rotors 27, 32 are accommodated in the fifth pump chamber 43 as engaged with each other. Each pump chamber 39–43 is divided by the associated rotors 23–32 into a suction zone and a pressure zone. The pressure in the pressure zone is higher than the pressure in the suction zone.

A gear housing member 33 is coupled with the rear housing member 14. A pair of through holes 141, 142 are formed in the rear housing member 14 (see FIG. 3). The rotary shafts 19, 20 extend respectively through the through holes 141, 142 and the associated recesses 47, 48. The rotary shafts 19, 20 thus project into the gear housing member 33 to form projecting portions 193, 203, respectively. A pair of gears 34, 35 are secured respectively to the projecting portions 193, 203 and are meshed together. An electric motor M is connected to the gear housing member 33. A shaft coupling 44 transmits the drive force of the motor M to the first rotary shaft 19. The motor M thus rotates the first rotary shaft 19 in the direction indicated by arrow R1 of FIGS. 2(*a*) to 2(*c*). The gears 34, 35 transmit the rotation of the first rotary shaft 19 to the second rotary shaft 20. The second rotary shaft 20 thus rotates in the direction indicated by arrow R2 of FIGS. 2(*a*) to 2(*c*). Accordingly, the first and second rotary shafts 19, 20 rotate in opposite directions. The gears 34, 35 form a gear mechanism to rotate the rotary shafts 19, 20 integrally.

A gear accommodating chamber 331 is formed in the gear housing member 33 and retains lubricant oil (not shown) for lubricating the gears 34, 35. The gear accommodating chamber 331 is a sealed oil zone. The gear housing member 33 and the rear housing member 14 thus form an oil housing, or an oil zone adjacent to the fifth pump chamber 43. The rear housing member 14 functions as a partition that separates the fifth pump chamber 43 from the oil zone. The gears 34, 35 rotate to agitate the lubricant oil in the gear accommodating chamber 331. The lubricant oil thus lubricates the radial bearings 37, 38. A gap 371, 381 of each radial bearing 37, 38 allows the lubricant oil to enter a portion of the associated recess 47, 48 that is located inward from the gap 371, 381.

The recesses 47, 48 are thus connected to the gear accommodating chamber 331 through the gaps 371, 381 and form part of the oil zone.

As shown in FIG. 2(*b*), a passage 163 is formed in the interior of each chamber forming wall 16. Each chamber forming wall 16 has an inlet 164 and an outlet 165 that are connected to the passage 163. The adjacent pump chambers 39–43 are connected to each other by the passage 163 of the associated chamber forming wall 16.

As shown in FIG. 2(*a*), an inlet 181 extends through the block section 18 of the cylinder block 15 and is connected to the suction zone of the first pump chamber 39. As shown in FIG. 2(*c*), an outlet 171 extends through the block section 17 of the cylinder block 15 and is connected to the pressure zone of the fifth pump chamber 43. When gas enters the first pump chamber 39 from the inlet 181, rotation of the first rotors 23, 28 sends the gas to the passage 163 of the adjacent chamber forming wall 16 from the inlet 164. The gas thus reaches the suction zone of the second pump chamber 40 from the outlet 165 of the passage 163. Afterwards, the gas flows from the second pump chamber 40 to the third, fourth, and fifth pump chambers 41, 42, 43 in this order, as repeating the above-described procedure. The volumes of the first to fifth pump chambers 39–43 become gradually smaller in this order. After the gas reaches the fifth pump chamber 43, the gas is discharged from the outlet 171 to the exterior of the vacuum pump 11. That is, each rotor 23–32 functions as a gas conveying body for conveying gas.

As shown in FIGS. 1(*a*) and 3, first and second annular shaft seals 49, 50 are securely fitted around the first and second rotary shafts 19, 20, respectively. The shaft seals 49, 50 are located in the associated recesses 47, 48 and rotate integrally with the associated rotary shafts 19, 20. A seal ring 51 is located between the inner circumferential side of the shaft seal 49 and a circumferential side 192 of the first rotary shaft 19. In the same manner, a seal ring 52 is located between the inner circumferential side of the shaft seal 50 and a circumferential side 202 of the second rotary shaft 20.

There is a gap between an outer circumferential side 491, 501 of a portion with a maximum diameter of each shaft seal 49, 50 and the circumferential wall 471, 481 of the associated recess 47, 48. Likewise, there is a gap between a front side 492, 502 of each shaft seal 49, 50 and a bottom 472, 482 of the associated recess 47, 48.

Figure 3:
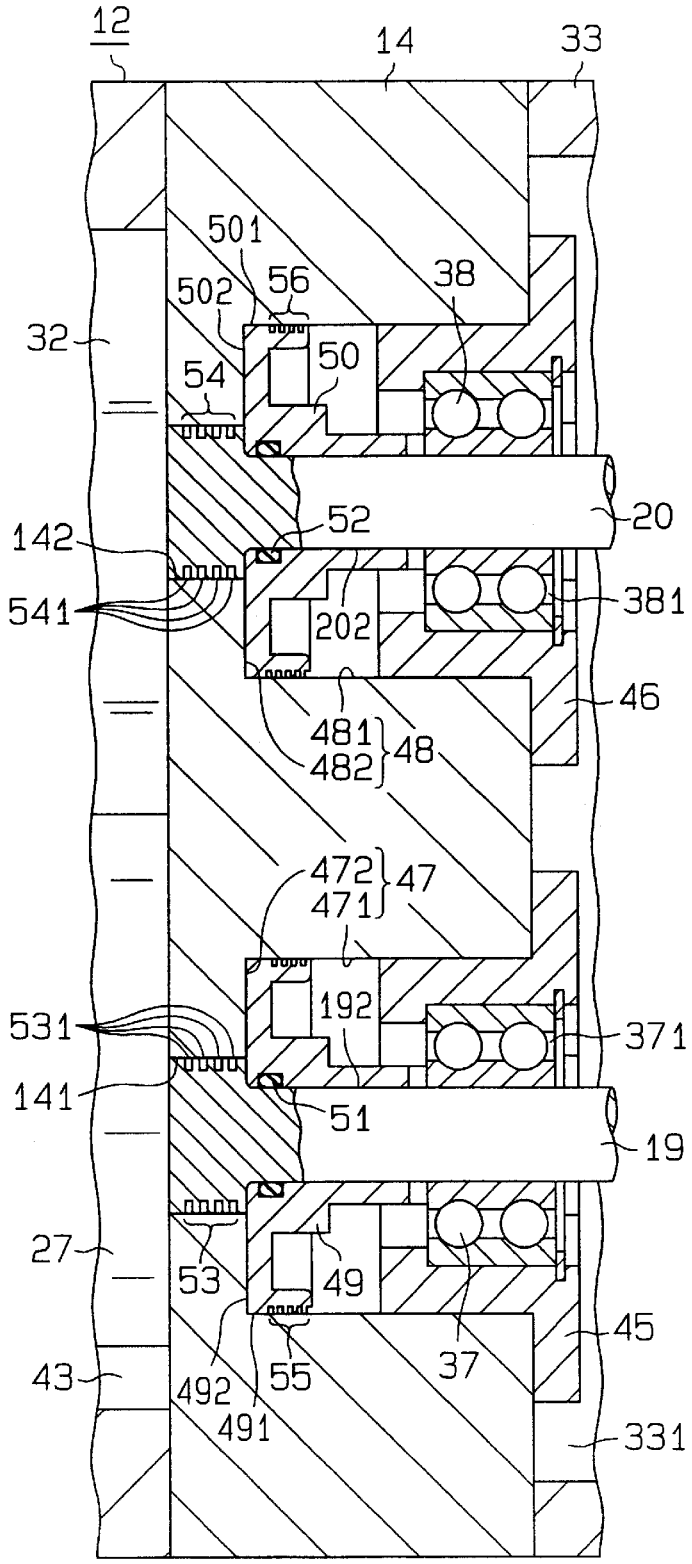
FIG. 3 is an enlarged cross-sectional view showing a main portion of the Roots pump of FIG. 1(*a*)
Figure 4A:
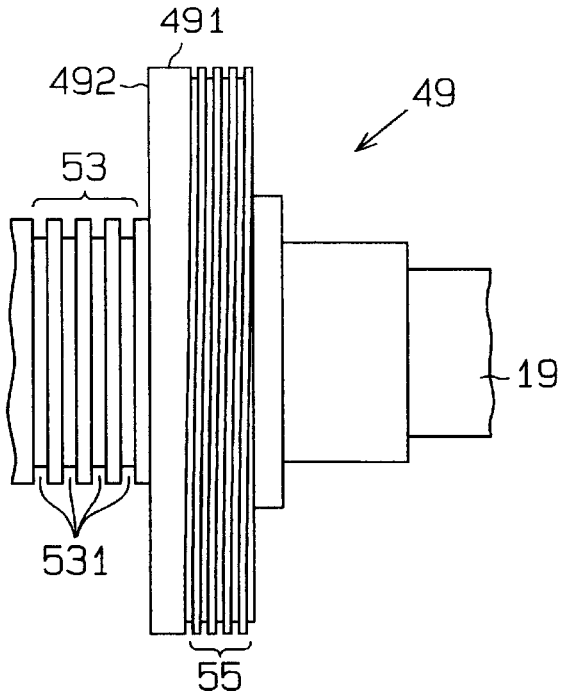
FIG. 4(*a*) is an enlarged plan view showing a main portion of a seal structure fitted around a first rotary shaft.
Figure 4B:
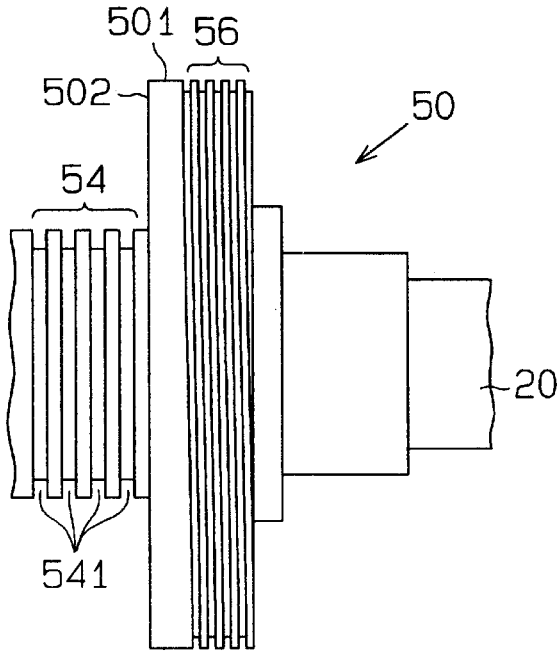

As shown in FIGS. 3 and 4(*a*), a first helical groove 55 is formed in the outer circumferential side 491 of the first shaft seal 49. As shown in FIGS. 3 and 4(*b*), a second helical groove 56 is formed in the outer circumferential side 501 of the second shaft seal 50. The first helical groove 55 forms a path from a side corresponding to the gear accommodating chamber 331 toward the fifth pump chamber 43 as viewed in the rotational direction R1 of the first rotary shaft 19. The second helical groove 56 forms a path from a side corresponding to the gear accommodating chamber 331 toward the fifth pump chamber 43 as viewed in the rotational direction R2 of the second rotary shaft 20. In this manner, each helical groove 55, 56 brings out a pumping effect that conveys fluid from a side corresponding to the fifth pump chamber 43 toward the gear accommodating chamber 331 when the rotary shafts 19, 20 rotate. That is, each helical groove 55, 56 forms a pumping means that urges the lubricant oil between the outer circumferential side 491, 501 of the associated shaft seal 49, 50 and the circumferential wall 471, 481 of the recess 47, 48 to move from a side corresponding to the fifth pump chamber 43 toward the oil zone. The outer circumferential side 491, 501 of each shaft seal 49, 50 and the circumferential wall 471, 481 of the associated recess 47, 48 form opposed seal forming surfaces.

As shown in FIGS. 3, 4(*a*), and 4(*b*), a labyrinth seal 53 is formed between the wall of the through hole 141 of the rear housing member 14 and the circumferential side 192 of the first rotary shaft 19. Further, a labyrinth seal 54 is formed between the wall of the through hole 142 of the rear housing member 14 and the circumferential side 202 of the second rotary shaft 20. A plurality of annular grooves 531, 541 are formed respectively around the circumferential sides 192, 202 of the rotary shafts 19, 20. Each labyrinth seal 53, 54 is formed by the associated annular grooves 531, 541. The annular grooves 531, 541 are aligned along the axis of the associated rotary shaft 19, 20.

The first embodiment has the following effects.

Each seal ring 51, 52, which is located between the shaft seal 49, 50 and the associated rotary shaft 19, 20, prevents lubricant oil from leaking from the associated recess 47, 48 to the fifth pump chamber 43 along the circumferential side 192, 202 of the rotary shaft 19, 20. Further, during the rotation of the first rotary shaft 19, the first helical groove 55 of the first shaft seal 49 forms a path along the circumferential wall 471 of the recess 47. This sends the lubricant oil corresponding to the path of the first helical groove 55 from a side corresponding to the fifth pump chamber 43 toward the gear accommodating chamber 331. In the same manner, the second helical groove 56 of the second shaft seal 50 forms a path along the circumferential wall 481 of the recess 48 during the rotation of the second rotary shaft 20. The lubricant oil corresponding to the path of the second helical groove 56 thus flows from a side corresponding to the fifth pump chamber 43 toward the gear accommodating chamber 331. Accordingly, the shaft seals 49, 50 with the helical grooves 55, 56, each of which functions as the pumping means, have an improved seal performance against the lubricant oil.

Each helical groove 55, 56 is located along the outer circumferential side 491, 501 of the associated shaft seal 49, 50, or the outer circumferential side of the portion with the maximum diameter of the shaft seal 49, 50. The circumferential speed thus becomes maximum at the portion at which each helical groove 55, 56 is located. Accordingly, each helical groove 55, 56 rotates at a relatively high speed. This efficiently urges the gas between the outer circumferential side 491, 501 of each shaft seal 49, 50 and the circumferential wall 471, 481 of the associated recess 47, 48 to move from a side corresponding to the fifth pump chamber 43 toward the gear accommodating chamber 331. The lubricant oil between the outer circumferential side of 491, 501 of each shaft seal 49, 50 and the circumferential wall 471, 481 of the associated recess 47, 48 follows the movement of the gas, thus efficiently moving from a side corresponding to the fifth pump chamber 43 toward the gear accommodating chamber 331. The location of each helical groove 55, 56 of this embodiment is thus preferable in preventing oil from leaking from the recesses 47, 48 to the fifth pump chamber 43.

If the number of the rotation cycles of each helical groove 55, 56 increases, the seal performance of each shaft seal 49, 50 improves. Since it is relatively easy to increase the number of the rotation cycles of the each helical groove 55, 56, the helical grooves 55, 56 are preferable pumping means.

Each rotary shaft 19, 20 includes a plurality of rotors that are formed integrally with the rotary shaft 19, 20. Thus, if each shaft seal 49, 50 is formed integrally with the associated rotary shaft 19, 20, the maximum diameter of the shaft seal 49, 50 must be selected with reference to the diameter of each through hole 141, 142 of the rear housing member 14. However, in this embodiment, each shaft seal 49, 50 is formed separately from the associated rotary shaft 19, 20. It is thus possible to shape and size the shaft seals 49, 50 to advantageously improve the pumping effect of the pumping means.

If lubricant oil leaks from the space between the outer circumferential side 491, 501 of each shaft seal 49, 50 and the circumferential wall 471, 481 of the associated recess 47, 48 to the through hole 141, 142, each labyrinth seal 53, 54 prevents the lubricant oil from entering the fifth pump chamber 43.

The labyrinth seals 53, 54 also function as gas seals. More specifically, the pressure in each pump chamber 39–43 becomes higher than the atmospheric pressure immediately after the Roots pump 11 is started. In this state, the labyrinth seals 53, 54 prevent gas from leaking from the fifth pump chamber 43 to the gear accommodating chamber 331 along the circumferential sides of the rotary shafts 19, 20. The labyrinth seals 53, 54 thus function as oil seals and gas seals and are optimal non-contact type seal means.

If the Roots pump 11 is a dry type, the lubricant oil does not circulate in any pump chamber 39–43. It is preferred that the present invention be applied to this type of pump.

Figure 5:
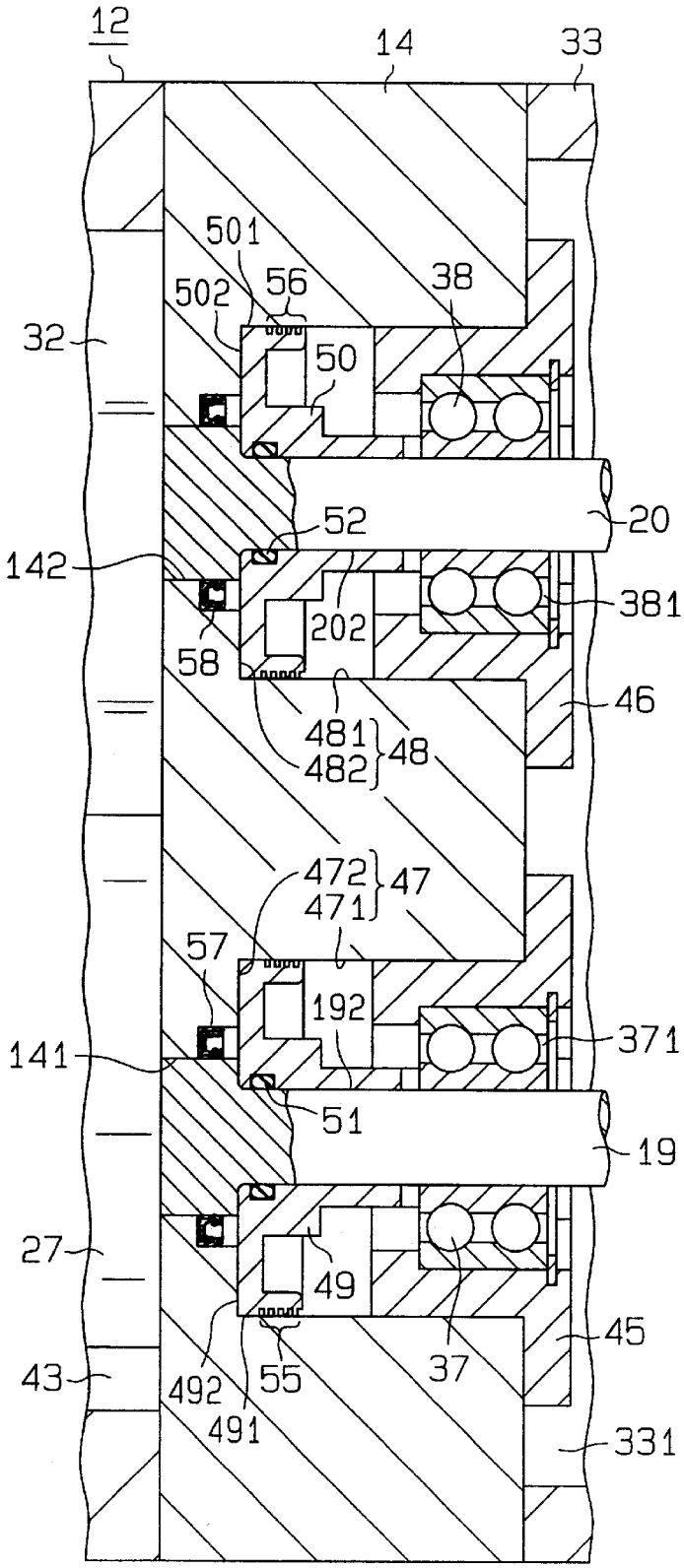
FIG. 5 is an enlarged cross-sectional view showing a main portion of a seal structure of a second embodiment according to the present invention.

Next, a second embodiment of the present invention will be described with reference to FIG. 5. The description focuses on the difference between the first embodiment, which is illustrated in FIGS. 1 to 4(*b*), and the second embodiment.

In the second embodiment, a pair of rubber lip seals 57, 58 replace the labyrinth seals 53, 54 of FIG. 3. The lip seals 57, 58 are fitted respectively in the through holes 141, 142. Each lip seal 57, 58 contacts and slide along the circumferential side 192, 202 of the associated rotary shaft 19, 20. If lubricant oil leaks from the space between the outer circumferential side 491, 501 of each shaft seal 49, 50 and the circumferential wall 471, 481 of the associated recess 47, 48 to the through hole 141, 142, each lip seal 57, 58 prevents the lubricant oil from entering the fifth pump chamber 43.

Figure 6:
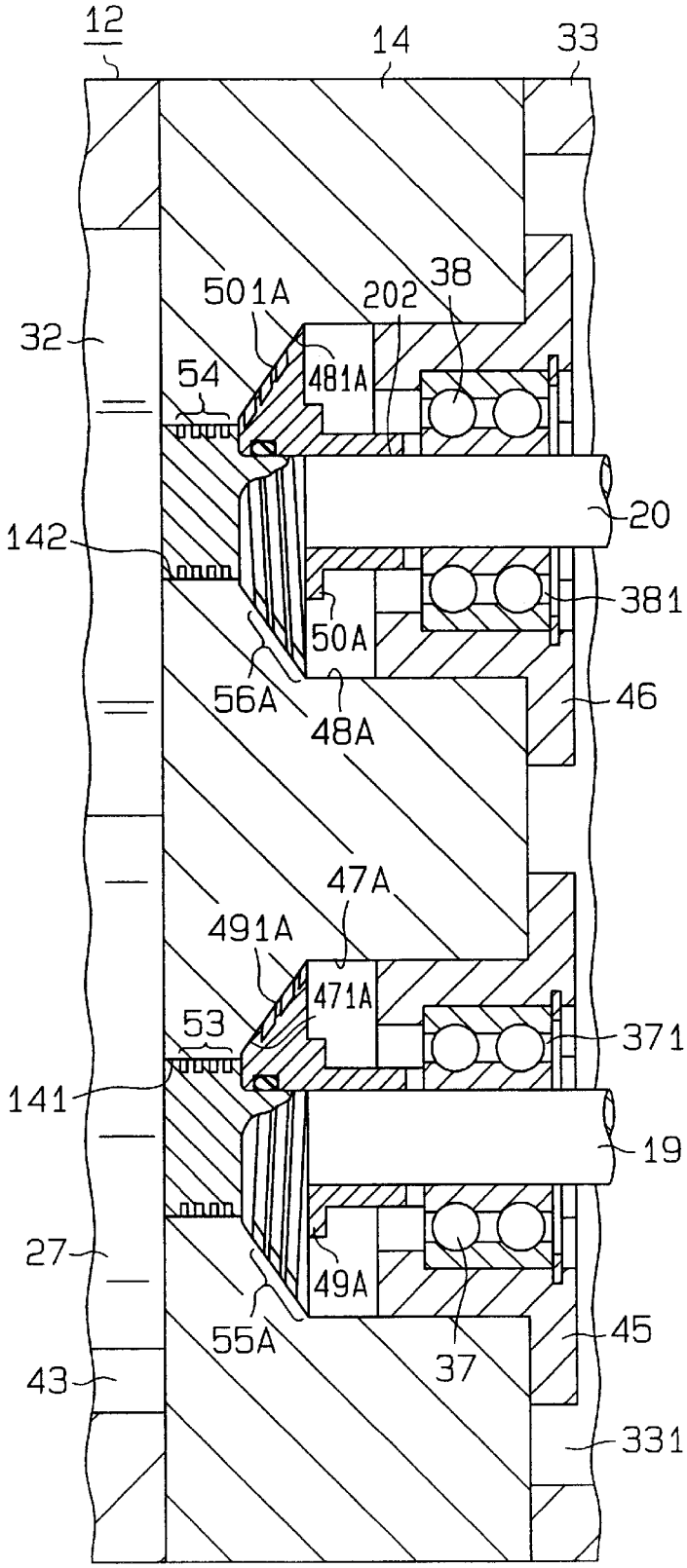
FIG. 6 is an enlarged cross-sectional view showing a main portion of a seal structure of a third embodiment according to the present invention.

A third embodiment of the present invention will be described with reference to FIG. 6. The description focuses on the difference between the first embodiment, which is illustrated in FIGS. 1 to 4(*b*), and the third embodiment.

In the third embodiment, a portion of a recess 47A forms a tapered surface 471A and a portion of a recess 48A forms a tapered surface 481A. Further, the outer circumferential sides of a pair of shaft seals 49A, 50A form tapered surfaces 491A, 501A, respectively. A pair of helical grooves 55A, 56A are formed respectively in the tapered surfaces 491A, 501A. The diameter of each tapered surface 491A, 501A, or each helical groove 55A, 56A, becomes gradually larger, as viewed from the fifth pump chamber 43 toward the gear accommodating camber 331. Thus, when the helical grooves 55A, 56A rotate, centrifugal force acts advantageously to urge lubricant oil to move from a side corresponding to the fifth pump chamber 43 toward the gear accommodating chamber 331.

Next, a fourth embodiment of the present invention will be described with reference to FIG. 7. The description focuses on the difference between the first embodiment, which is illustrated in FIGS. 1 to 4(*b*), and the fourth embodiment.

This embodiment includes a pair of shaft seals 49B, 50B. A pair of rubber sliding rings 59, 60 are respectively fitted around the shaft seals 49B, 50B. A plurality of leak preventing projections 591 are formed around the sliding ring 59, and a plurality of leak preventing projections 601 are formed around the sliding ring 60. When the first rotary shaft 19 rotates, the leak preventing projections 591 slide along the circumferential wall 471 of the recess 47 in a contact manner. Likewise, when the second rotary shaft 20 rotates, the leak preventing projections 601 slide along the circumferential wall 481 of the recess 48 in a contact manner. Each leak preventing projection 591, 601 does not cover the entire circumference around the axis of the associated shaft seal 49B, 50B, or the axis 191, 201 of the associated rotary shaft 19, 20, and is formed diagonally with respect to the axis 191, 201. Each leak preventing projection 591, 601 forms a path from a side corresponding to the gear accommodating chamber 331 toward the fifth pump chamber 43, as viewed in the rotational direction Rl, R2 of the associated rotary shaft 19, 20.

When the first rotary shaft 19 rotates, the leak preventing projections 591 urge the lubricant oil between the circumferential wall 471 of the recess 47 and the outer circumferential side of the first shaft seal 49B to move from a side corresponding to the fifth pump chamber 43 toward the gear accommodating chamber 331. In the same manner, when the second rotary shaft 20 rotates, the leak preventing projections 601 urge the lubricant oil between the circumferential wall 481 of the recess 48 and the outer circumferential side of the second shaft seal 50B to move from a side corresponding to the fifth pump chamber 43 toward the gear accommodating chamber 331.

If a single leak preventing projection is formed around the entire circumference around the axis 191, 201 of each rotary shaft 19, 20, the axial dimension of each sliding ring 59, 60 needs to be enlarged. In this case, the resistance to the sliding of each sliding ring 59, 60 becomes relatively large, which is not preferable. In contrast, the leak preventing projections 591, 601 of the fourth embodiment do not require the enlargement of the axial dimensions of the sliding rings 59, 60.

A fifth embodiment of the present invention will hereafter be described with reference to FIG. 8. The description focuses on the difference between the first embodiment, which is illustrated in FIGS. 1 to 4(*b*), and the fifth embodiment.

A shaft seal 49C is formed integrally with the first rotary shaft 19 and is connected to the fifth rotor 27. In the same manner, a shaft seal 50C is formed integrally with the second rotary shaft 20 and is connected to the fifth rotor 32. A pair of recesses 61, 62 are formed in a wall of the rear housing member 14 that opposes the rotor housing member 12. The shaft seals 49C, 50C are fitted respectively in the recesses 61, 62. A labyrinth seal 53 is formed between the outer circumferential side of the shaft seal 49C and a circumferential wall 611 of the recess 61. A labyrinth seal 54 is formed between the outer circumferential side of the shaft seal 50C and a circumferential wall 621 of the recess 62. A first helical groove 63 is formed in a side of the shaft seal 49C that opposes a bottom 612 of the recess 61, and a second helical groove 64 is formed in a side of the shaft seal 50C that opposes a bottom 622 of the recess 62.

Each helical groove 63, 64 defines a path toward the axis of the associated shaft seal 49C, 50C, as viewed in the rotational direction R1, R2 of the associated rotary shaft 19, 20. Thus, when the rotary shafts 19, 20 rotate, the helical grooves 63, 64 bring out a pumping effect, or send fluid from a side corresponding to the fifth pump chamber 43 toward the gear accommodating chamber 331.

A sixth embodiment of the present invention will hereafter be described with reference to FIGS. 9(*a*) to 10(*b*). The description focuses on the difference between the first embodiment, which is illustrated in FIGS. 1 to 4(*b*), and the sixth embodiment.

Figure 9A:
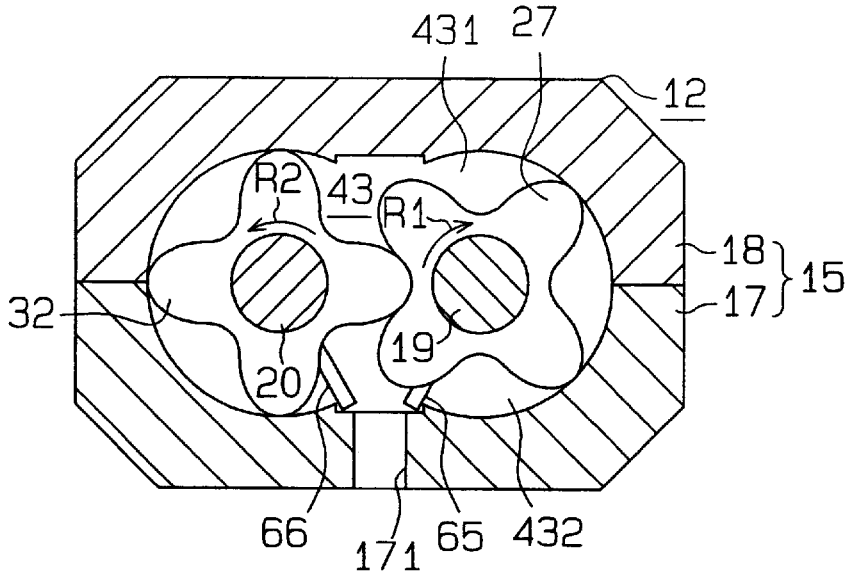
FIG. 9(*a*) is a cross-sectional view showing a sixth embodiment of the present invention and corresponding to FIG. 2(*c*)
Figure 9B:
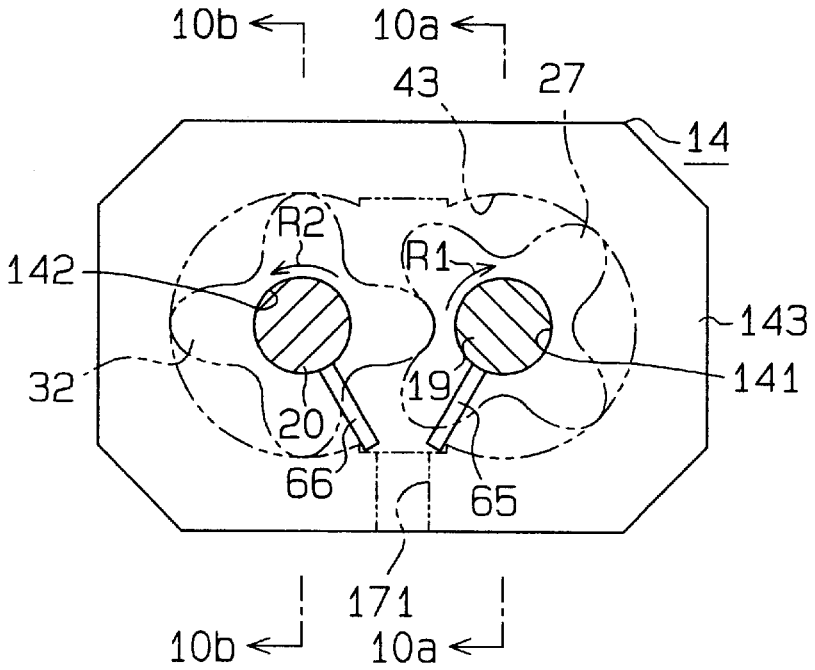
Figure 10B:
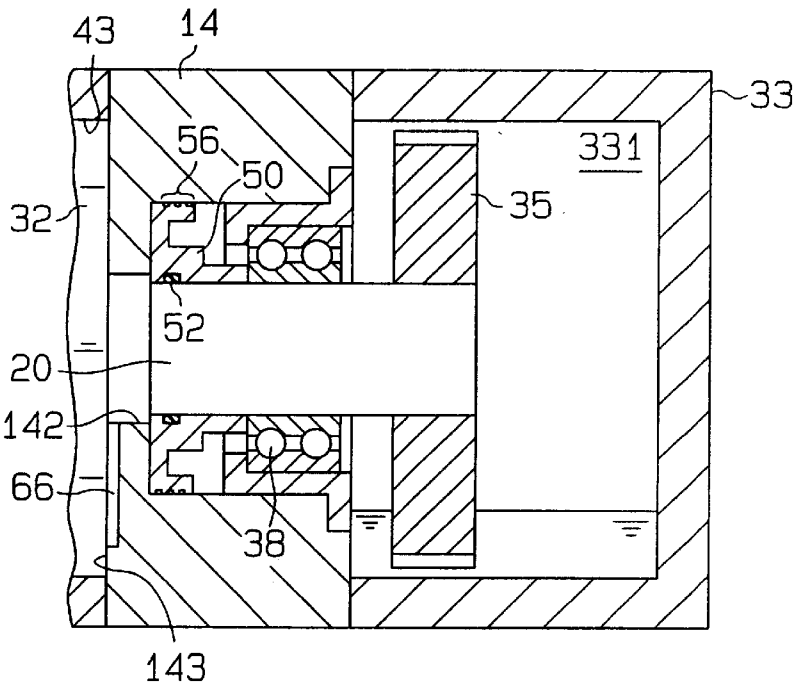
FIG. 10(*a*) is a cross-sectional view taken along line 10*a*—10*a* of FIG. 9(*b*)
Figure 10A:
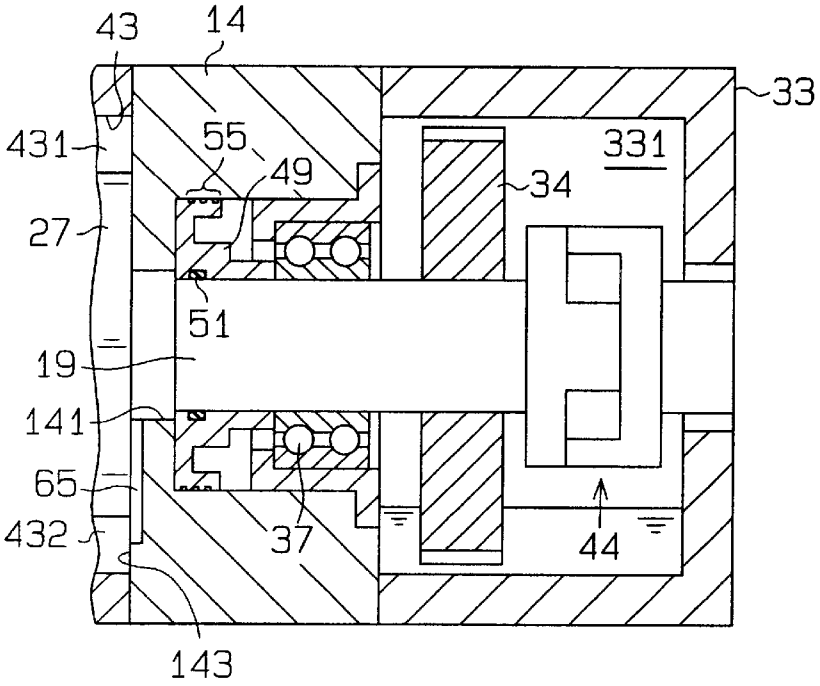

As shown in FIG. 9(*a*), after having been sent from the fourth pump chamber 42 to the suction zone 431 of the fifth pump chamber 43, refrigerant gas reaches the pressure zone 432 and is discharged to the exterior from the outlet 171 through rotation of the fifth rotors 27, 32. The outlet 171 functions as a discharge passage for discharging gas to the exterior of the vacuum pump 11. The fifth pump chamber 43 is a final-stage pump chamber that is connected to the outlet 171. Among the pressure zones of the first to fifth pump chambers 39–43, the maximum pressure acts in the pressure zone 432 of the fifth pump chamber 43 such that the pressure zone 432 functions as a maximum pressure zone.

As shown in FIGS. 9(*a*) to 10(*b*), first and second discharge pressure introducing lines 65, 66 are formed in a chamber forming wall surface 143 of the rear housing member 14 that forms the final-stage fifth pump chamber 43.

As shown in FIGS. 9(*b*) and 10(*a*), the first discharge pressure introducing line 65 is connected to the maximum pressure zone 432 the volume of which is varied by rotation of the fifth rotors 27, 32. The first discharge pressure introducing line 65 is connected also to the through hole 141 through which the first rotary shaft 19 extends. As shown in FIGS. 9(*b*) and 10(*b*), the second discharge pressure introducing line 66 is connected to the maximum pressure zone 432 and the through hole 142 through which the second rotary shaft 20 extends.

The sixth embodiment has the following effects.

The circumferential side 192 of the first rotary shaft 19 forms a slight gap with respect to the wall of the through hole 141. Also, each fifth rotor 27, 32 forms a slight gap with respect to the chamber forming wall surface 143 of the rear housing member 14. These gaps introduce the pressure in the final-stage, fifth pump chamber 43 to the first helical groove 55. Further, the circumferential side 202 of the second rotary shaft 20 forms a slight gap with respect to the wall of the through hole 142. The pressure in the fifth pump chamber 43 is thus introduced to the second helical groove 56.

Without the discharge pressure introducing lines 65, 66, the helical grooves 55, 56 are equally affected by the pressure in the suction zone 431 and the pressure in the pressure zone 432 of the fifth pump chamber 43. More specifically, if the pressure in the suction zone 431 is P1 and the pressure in the maximum pressure zone 432 is P2 (P2>P1), each helical groove 55, 56 receives about half the total of the pressures P1, P2 ((P2+P1)/2) from the fifth pump chamber 43.

The pressure in each recess 47, 48, which is connected to the gear accommodating chamber 331, corresponds to the atmospheric pressure (approximately 1000 Torr) that remains non-affected by operation of each rotor 23–32.

Each discharge pressure introducing line 65, 66 of this embodiment improves the effect of introducing the pressure in the maximum pressure zone 432 to the associated helical grooves 55, 56. That is, the effect of introducing the pressure in the maximum pressure zone 432 to the helical grooves 55, 56 through the discharge pressure introducing lines 65, 66 dominates the effect of introducing the pressure in the suction zone 431 to the helical grooves 55, 56. Thus, the pressure received by each helical groove 55, 56 becomes much larger than the aforementioned value (P2+P1)/2. Accordingly, the pressure difference between an end closest to the fifth pump chamber 43 and an end closest to the gear accommodating chamber 331 of each helical groove 55, 56 becomes much smaller than the value [1000–(P2+P1)/2] Torr. As a result, the oil leak preventing effect of each helical groove 55, 56 is improved.

The effect of introducing the pressure in the maximum pressure zone 432 to each helical groove 55, 56 depends on the communication area of each discharge pressure introducing line 65, 66. Since the discharge pressure introducing line 65, 66 with a desired communication area is easy to accomplish, the discharge pressure introducing lines 65, 66 optimally introduce the pressure in the maximum pressure zone 432 to the helical grooves 55, 56.

The discharge pressure introducing lines 65, 66 are located in the chamber forming wall surface 143 that forms the fifth pump chamber 43. Each through hole 141, 142, through which the associated rotary shaft 19, 20 extends, is formed in the chamber forming wall surface 143. The maximum pressure zone 432 of the fifth pump chamber 43 faces the chamber forming wall surface 143. Accordingly, each discharge pressure introducing line 63, 64 is readily formed in the chamber forming wall surface 143 such that the line 65, 66 is connected to the maximum pressure zone 432 and the associated through hole 141, 142.

The present invention may be modified as follows.

Figure 7:
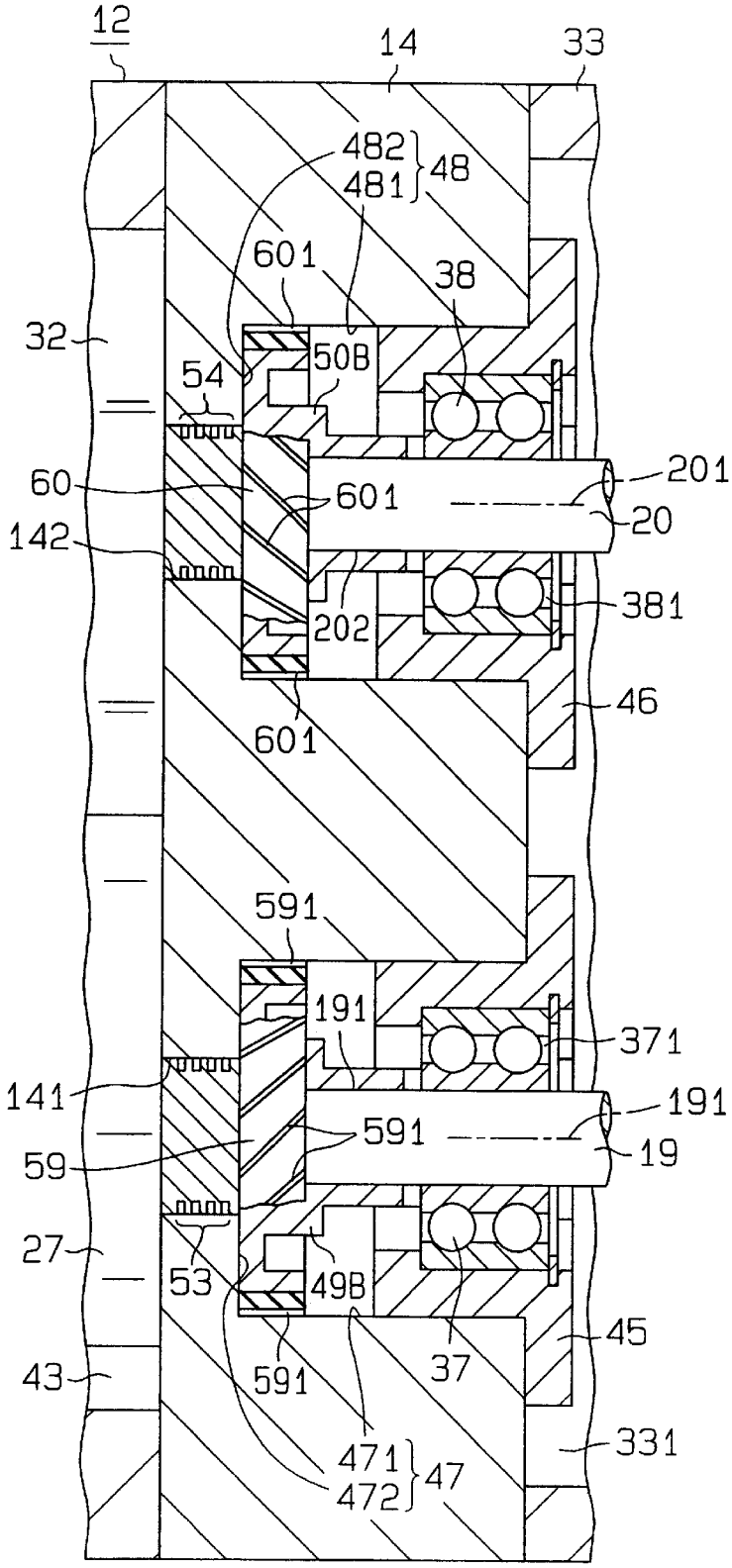
FIG. 7 is an enlarged cross-sectional view showing a main portion of a seal structure of a fourth embodiment according to the present invention.

In the fourth embodiment of FIG. 7, the shaft seals 49B, 50B may be formed of rubber. Further, a leak preventing projection may be formed integrally with each seal 49B, 50B at the circumferential side of the shaft seal 49B, 50B.

Figure 8:
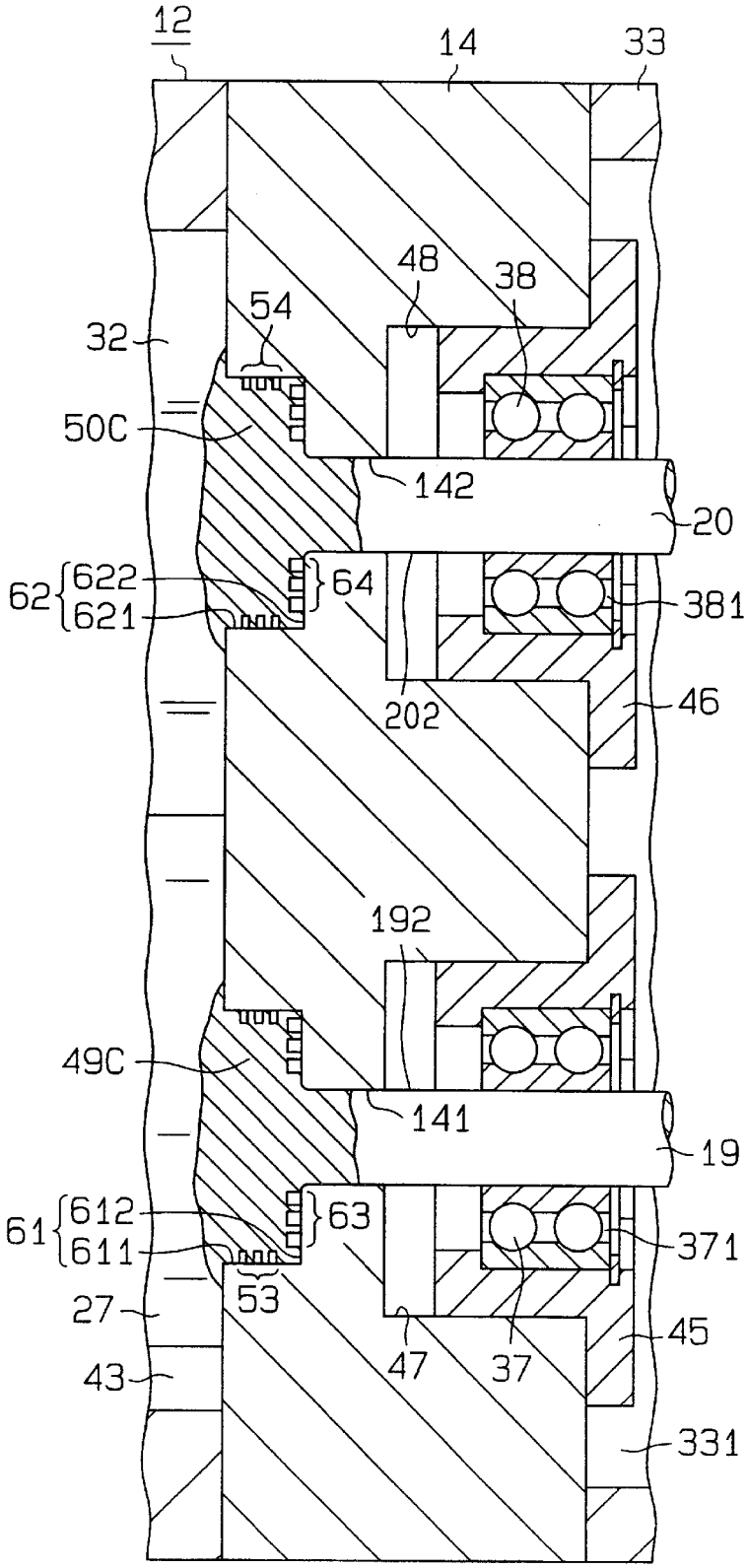
FIG. 8 is an enlarged cross-sectional view showing a main portion of a seal structure of a fifth embodiment according to the present invention.

In the fifth embodiment of FIG. 8, each labyrinth seal 53, 54 may be replaced by a helical groove formed in the circumferential side of the associated shaft seal 49C, 50C.

A helical groove may be formed in a side of the rear housing member 14 that opposes the rotor housing member 12.

The present invention may be applied to other types of vacuum pumps than the Roots type.

The present example and embodiments are to be considered as illustrative and not restrictive and the invention is not to be limited to the details given herein, but may be modified within the scope and equivalence of the appended claims.

What is claimed is:

1. A vacuum pump that draws gas by operating a gas conveying body in a pump chamber through rotation of a rotary shaft, the vacuum pump comprising:

an oil housing member, wherein the oil housing member forms an oil zone adjacent to the pump chamber, and the rotary shaft has a projecting section that projects from the pump chamber to the oil zone through a through hole formed in the oil housing member;

an annular shaft seal, which is located around the projecting section to rotate integrally with the rotary shaft, wherein the shaft seal has a first seal forming surface that opposes the oil housing member;

a second seal forming surface, which is formed on the oil housing member, wherein the second seal forming surface opposes the first seal forming surface;

a pumping means, which is formed at the first seal forming surface, wherein the pumping means urges oil between the first and second seal forming surfaces to move from a side corresponding to the pump chamber toward the oil zone when the rotary shaft rotates; and a pressure introducing line that introduces the pressure in a maximum pressure zone located in the pump chamber to the pumping means through the through hole.

2. The vacuum pump according to claim 1, wherein the shaft seal is formed independently from the rotary shaft, a seal ring is located between the shaft seal and the rotary shaft, and the seal ring prevents the oil from leaking from the oil zone to the pump chamber along a circumferential side of the rotary shaft.

3. The vacuum pump according to claim 1, wherein the pressure introducing line is formed in the oil housing member.

4. The vacuum pump according to claim 1, wherein the oil housing member has a wall surface exposed to the maximum pressure zone, and the pressure introducing line is a groove formed in the wall surface.

5. The vacuum pump according to claim 1, further comprising a bearing that supports the rotary shaft, wherein the bearing is supported by the oil housing member and is located in the oil zone.

6. The vacuum pump according to claim 1, wherein the oil housing member has a recess in which the shaft seal is accommodated, and the second seal forming surface forms a wall portion of the recess.

7. The vacuum pump according to claim 6, wherein the first seal forming surface is an outer circumferential side of the shaft seal, and the second seal forming surface is a circumferential wall of the recess.

8. The vacuum pump according to claim 3, wherein each seal forming surface is a tapered surface with a diameter that gradually increases from a side corresponding to the pump chamber toward the oil zone.

9. The vacuum pump according to claim 7, wherein the pumping means is a helical groove, and the helical groove forms a path from a side corresponding to the oil zone toward the pump chamber as viewed in a rotational direction of the rotary shaft.

10. The vacuum pump according to claim 6, wherein the first seal forming surface is an end surface of the shaft seal, and the second seal forming surface is a bottom of the recess.

11. The vacuum pump according to claim 10, wherein the pumping means is a helical groove, and the helical groove forms a path toward the axis of the shaft seal as viewed in a rotational direction of the rotary shaft.

12. The vacuum pump according to claim 1, wherein the rotary shaft is one of a plurality of parallel rotary shafts, a gear mechanism connects the rotary shafts to one another such that the rotary shafts rotate integrally, and the gear mechanism is located in the oil zone.

13. The vacuum pump according to claim 12, wherein a plurality of rotors are formed around each rotary shaft such that each rotor functions are the gas conveying body, and the rotors of one rotary shaft are engaged with the rotors of another rotary shaft.

14. A vacuum pump draws gas by operating a gas conveying body in a pump chamber through rotation of a rotary shaft, the vacuum pump comprising:

a housing, wherein the housing has the pump chamber and an oil zone, the housing includes a partition that separates the pump chamber from the oil zone, and the rotary shaft extends from the pump chamber to the oil zone through a through hole formed in the partition;

an annular shaft seal, which is fitted around the rotary shaft to rotate integrally with the rotary shaft, wherein the shaft seal has a first seal forming surface that opposes the partition;

a second seal forming surface, which is formed on the partition, wherein the second seal forming surface opposes the first seal forming surface;

a pumping mechanism, which is formed at the first seal forming surface, wherein the pumping mechanism urges oil between the first and second seal forming surfaces to move from a side corresponding to the pump chamber toward the oil zone when the rotary shaft rotates; and a pressure introducing line that introduces the pressure in a maximum pressure zone located in the pump chamber to the pumping mechanism through the through hole.

15. A Roots pump, comprising:

a housing, wherein the housing has a pump chamber and an oil zone, and the housing includes a partition that separates the pump chamber from the oil zone;

a pair of parallel rotary shafts, wherein each rotary shaft extends from the pump chamber to the oil zone through one of a pair of through holes formed in the partition;

a pair of rotors, each of which is located in the pump chamber and is formed around one of the rotary shafts, wherein the rotor of one rotary shaft engages with the rotor of the other;

a gear mechanism, which is located in the oil zone, wherein the gear mechanism connects the rotary shafts to each other such that the rotary shafts rotate integrally;

a pair of annular shaft seals, each of which is located in the oil zone and is fitted around one of the rotary shafts to rotate integrally with the rotary shaft, wherein each shaft seal has a first seal forming surface that opposes the partition;

a pair of second seal forming surfaces, which are formed on the partition, wherein each second seal forming surface opposes one of the first seal forming surfaces;

a pair of pumping means, each at which is formed at one of the first seal forming surfaces, wherein each pumping means urges oil between the associated first and second seal forming surfaces to move from a side corresponding to the pump chamber toward the oil zone when the associated rotary shaft rotates; and a pair of pressure introducing lines, each of which introduces the pressure in a maximum pressure zone located in the pump chamber to one of the pumping means through one of the through holes.

16. The Roots pump according to claim 15, wherein the partition includes a pair of recesses, in each of which one of the shaft seals is accommodated, each second seal forming surface is a circumferential wall of one of the recesses, and each first seal forming surface is an outer circumferential side of one of the shaft seals.

17. The Roots pump according to claim 16, wherein each pumping means is a helical groove, and the helical groove forms a path from a side corresponding to the oil zone toward the pump chamber as viewed in a rotational direction of the associated rotary shaft.

* * * * *

UNITED STATES PATENT AND TRADEMARK OFFICE

CERTIFICATE OF CORRECTION

PATENT NO. : 6,663,367 B2
DATED : December 16, 2003
INVENTOR(S) : Shinya Yamamoto et al.

It is certified that error appears in the above-identified patent and that said Letters Patent is hereby corrected as shown below:

Column 10,
Line 50, please delete “3” and insert therefore -- 7 --

Signed and Sealed this

Sixth Day of April, 2004

JON W. DUDAS
*Acting Director of the United States Patent and Trademark Office*